US008363878B2

(12) United States Patent
Akino

(10) Patent No.: US 8,363,878 B2
(45) Date of Patent: Jan. 29, 2013

(54) ELECTROACOUSTIC TRANSDUCER

(75) Inventor: Hiroshi Akino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 138 days.

(21) Appl. No.: 12/926,469

(22) Filed: Nov. 19, 2010

(65) Prior Publication Data

US 2011/0158458 A1 Jun. 30, 2011

(30) Foreign Application Priority Data

Dec. 25, 2009 (JP) ..... 2009-294266

(51) Int. Cl.
*H04R 25/00* (2006.01)

(52) U.S. Cl. ..... 381/398; 381/430; 381/433

(58) Field of Classification Search ..... 381/396, 381/398, 423, 424, 430, 433, 391, 189; 181/171, 181/172, 173; 29/594, 609.1
See application file for complete search history.

(56) References Cited

U.S. PATENT DOCUMENTS 5,255,328 A * 10/1993 Akiniwa et al. ..... 381/398
5,892,185 A * 4/1999 Takahashi et al. ..... 181/171
6,996,246 B2 * 2/2006 Ito ..... 381/398

* cited by examiner

*Primary Examiner* — Huyen D Le
(74) *Attorney, Agent, or Firm* — Manabu Kanesaka

(57) ABSTRACT

An electroacoustic transducer includes a diaphragm having a center dome and a sub dome connectingly provided around the center dome, and a unit frame for oscillatably supporting the diaphragm. The sub dome is formed with a flat flange part at the peripheral edge thereof, and the unit frame is formed with a flat support face facing the flange part. The flange part is attached to the support face via an adhesive. The bonding area of the support face and the flange part increases gradually from an inside end of the support face to an outside end thereof. The support face may include a plurality of first bosses arranged at predetermined intervals along the inside end thereof, and a plurality of second bosses each having a diameter larger than that of the first boss arranged at predetermined intervals on the outside of the first boss group.

5 Claims, 4 Drawing Sheets

ELECTROACOUSTIC TRANSDUCER

CROSS-REFERENCE TO RELATED APPLICATION

The present application is based on, and claims priority from, Japanese Application Serial Number JP2009-294266, filed Dec. 25, 2009, the disclosure of which is hereby incorporated by reference herein in its entirety.

TECHNICAL FIELD

The present invention relates to an electroacoustic transducer applied to a dynamic microphone and a dynamic headphone. More particularly, it relates to a technique for attaching the peripheral edge portion of a diaphragm to a unit frame.

BACKGROUND ART

Referring to FIG. 5, an electroacoustic transducer includes, as a basic configuration, a diaphragm 10, a magnetic circuit part 20, and a unit frame 30 for supporting these elements.

The diaphragm 10 has a center dome 11 and a sub dome 12 integrally provided around the center dome 11, and the entire thereof consists of a thin film made of a synthetic resin. On the back surface side of the diaphragm 10, a voice coil 13 is fixed to the boundary portion between the center dome 11 and the sub dome 12 with an adhesive. In some cases, the sub dome 12 is also called an edge.

The magnetic circuit part 20 includes a yoke 21 formed in a dish shape, a disc-shaped permanent magnet 22 disposed in the center of the yoke 21, and a center pole piece 23 disposed over the permanent magnet 22. The permanent magnet 22 is magnetized in the plate thickness direction, and thereby a magnetic gap G is formed between the center pole piece 23 and the opening end portion of the yoke 21.

The unit frame 30 consists of a disc body having a cylinder part 31 in which the magnetic circuit part 20 is fitted in the central portion thereof, and in the outer peripheral portion thereof, a rib 32 for positioning the diaphragm 10 is formed in a ring form. Also, on the inside of the rib 32, a flat support face 33 is formed.

Referring to FIGS. 6 and 7, at the peripheral edge of the sub dome 12, a flat flange part 12*a* is provided. The diaphragm 10 is configured so that the flange part 12*a* is fixed to the support face 33 with an adhesive 40 in such a manner that the voice coil 13 can oscillate in the magnetic gap G.

In the case of a headphone and a speaker (electroacoustic transducers), the voice coil 13 functions as a driving coil for oscillating the diaphragm 10 by sound signals applied from the outside, and sounds are discharged from the diaphragm 10. In the case of a microphone (electroacoustic transducer), the voice coil 13 functions as a power generating coil, and sound signals are generated from the voice coil 13.

In both the cases, when the control system is mass control, the low frequency limit capable of capturing or reproducing sounds is determined by the resonance frequency of low frequency region. For this reason, the sub dome 12 is designed so that the stiffness of the diaphragm 10 is low.

However, since the mechanical strength of the sub dome 12 is low, when the flange part 12*a* is bonded to the unit frame 30, as shown in FIG. 7, internal stresses F1 and F2 remain sometimes in the sub dome 12 on account of the shrinkage of the adhesive 40 or if the bonding is performed in a state in which a stress is applied to the flange part 12*a*. The internal stresses F1 and F2 are liable to occur especially in a portion where the adhesive 40 squeezes out.

By such internal stresses, the piston-like movement of the entire of the diaphragm 10 is restrained. For the headphone, so-called chattering noise (abnormal resonance) is generated, and for the microphone, the frequency response in the middle and high frequency regions is deteriorated. Also, troublesomely, the internal stresses are not generated uniformly, and vary between individual portions.

To solve these problems, as the adhesive, an ultraviolet-curing resin that shows elasticity even after curing is preferably used, and after the diaphragm 10 has been placed on the unit frame 30 in such a manner that the internal stresses do not remain, the flange part 12*a* is bonded to the unit frame 30 with the aforementioned ultraviolet-curing resin. Also, in the invention described in Japanese Utility Model No. 2548580, a viscous liquid that does not cure is interposed between the flange part 12*a* and the support face 33.

Thus, the configuration is made such that the abnormal resonance of the sub dome 12 is prevented by mechanically braking the bonding portion of the sub dome 12. However, the mechanical impedance in the bonding portion still increases suddenly as viewed from the sub dome 12 side. Therefore, end reflected waves (the arrow mark B in FIG. 5), which is caused by the reflection of traveling waves (the arrow mark A in FIG. 5) propagated from the center dome 11 side on the end face of the bonding portion, are liable to occur, and therefore the abnormal resonance cannot be prevented reliably.

Accordingly, an object of the present invention is to provide an electroacoustic transducer in which abnormal resonance caused by end reflected waves in the bonding portion of a diaphragm and a unit frame is prevented.

SUMMARY OF THE INVENTION

To achieve the above object, the present invention provides an electroacoustic transducer including a diaphragm having a center dome and a sub dome connectingly provided around the center dome, and a unit frame for oscillatably supporting the diaphragm, the sub dome being formed with a flat flange part at the peripheral edge thereof; the unit frame being formed with a flat support face facing the flange part; and the flange part being attached to the support face via an adhesive, wherein the bonding area of the support face and the flange part increases gradually from an inside end of the support face to an outside end thereof.

According to the preferred mode of the present invention, the support face includes a first boss group in which a plurality of first bosses are arranged at predetermined intervals along the inside end of the support face, and a second boss group in which a plurality of second bosses each having a diameter larger than that of the first boss are arranged at predetermined intervals on the outside of the first boss group. Also, as the adhesive, an adhesive showing elasticity even after curing is used.

According to the present invention, the mechanical impedance in the bonding portion of the flange part of sub dome and the support face of unit frame increases at a predetermined gradient from the inside end of support face toward the outside end thereof. Therefore, the traveling waves propagated from the center dome are absorbed by the bonding portion, and the occurrence of end reflected waves that are a cause for abnormal resonance can be prevented.

DETAILED DESCRIPTION

Embodiments of the present invention will now be described with reference to FIGS. 1 to 4. The present invention is not limited to the embodiments.

Figure 1:
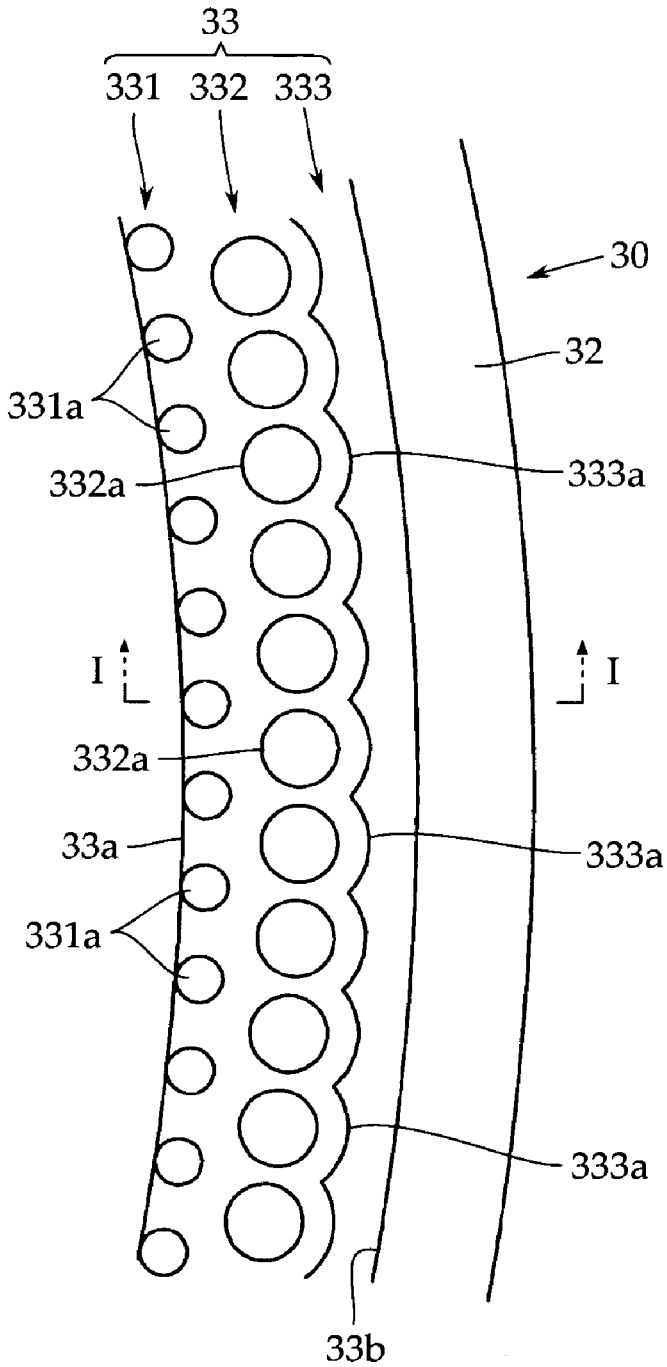
FIG. 1 is a plan view enlargedly showing a part of a support face of a unit frame, which is an essential portion of the present invention.
Figure 2:
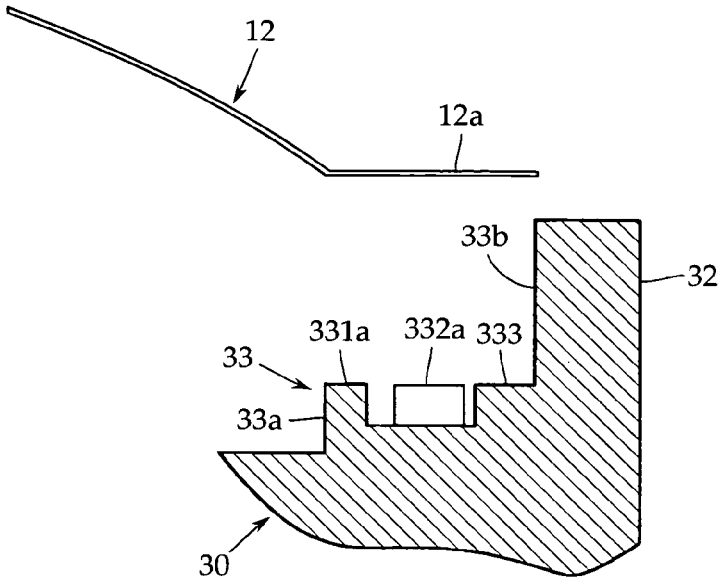
FIG. 2 is a sectional view taken along the line I-I of FIG. 1.
Figure 5:
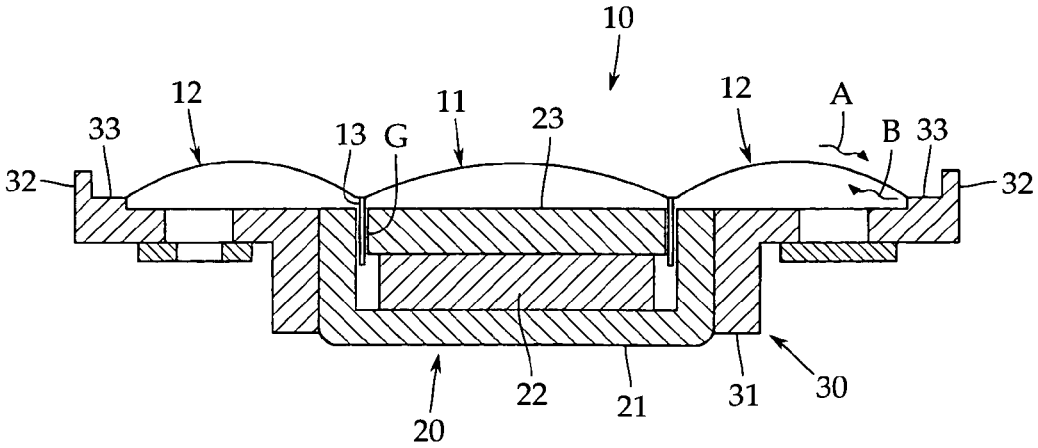
FIG. 5 RELATED ART
FIG. 5 is a sectional view of an electroacoustic transducer of a conventional art.
Figure 6:
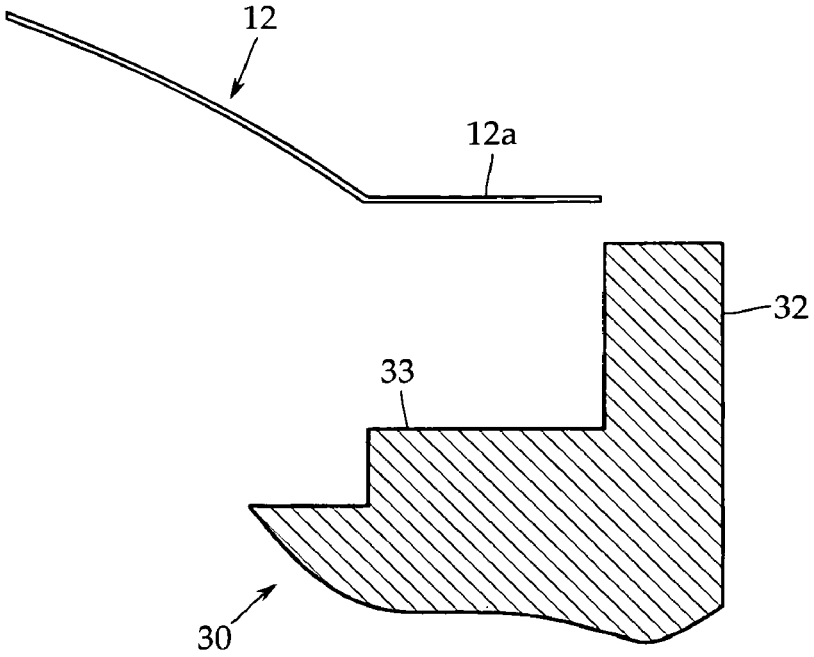
FIG. 6 RELATED ART
FIG. 6 is an enlarged sectional view showing a support face of a unit frame of the electroacoustic transducer shown in FIG. 5.
Figure 7:
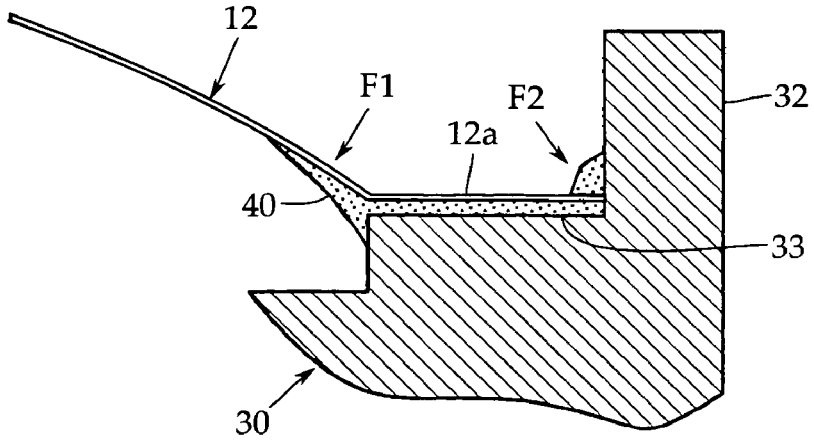
FIG. 7 RELATED ART
FIG. 7 is an enlarged sectional view similar to FIG. 6, showing a bonded state of the electroacoustic transducer shown in FIG. 5.

FIG. 1 shows only a part of a support face 33 of a unit frame 30, which is an essential portion of the present invention. An electroacoustic transducer of the present invention includes, like the conventional example explained with reference to FIG. 5, a diaphragm 10, a magnetic circuit part 20, and the unit frame 30 for supporting these elements. Also, as shown in FIG. 2, at the peripheral edge of a sub dome 12, a flat flange part 12*a* that is bonded to the support face 33 is formed.

In FIG. 1, as viewed from the center of the unit frame 30, taking the inside and outside ends of the support face 33 as 33*a* and 33*b*, respectively, according to the present invention, to prevent end reflected waves from occurring in a bonding portion, the configuration is made such that the bonding area of the support face 33 and the flange part 12*a* increases gradually from the inside end 33*a* to the outside end 33*b*. Thereby, the mechanical impedance in the bonding portion is increased at a predetermined gradient from the inside end 33*a* of the support face 33 to the outside end 33*b* thereof. The outside end 33*b* of the support face 33 is also the inner periphery of a rib 32 provided on the outer periphery side of the unit frame 30.

As one example for the above-described configuration, in this embodiment, the support face 33 of the flange part 12*a* includes a first boss group 331 having the smallest bonding area, a second boss group 332 having a large bonding area, and a flat part 333 having the largest bonding area.

The first boss group 331 includes a plurality of first bosses 331*a* each having a small diameter, and the first bosses 331*a* are arranged at predetermined intervals in a ring form along the inside end 33*a* of the support face 33.

The second boss group 332 includes a plurality of second bosses 332*a* each having a diameter larger than that of the first boss 331*a*, and the second bosses 332*a* are arranged at predetermined intervals in a ring form on the outside of the first boss group 331 so as to surround the first boss group 331.

The flat part 333 is disposed on the outside end 33*b* side of the support face 33, and is formed as a continuous ring-shaped body along the inner peripheral face of the rib 32 so as to surround the second boss group 332.

The upper faces of the first bosses 331*a*, the second bosses 332*a*, and the flat part 333 exist on the identical plane, and form the support face 33 for the flange part 12*a*.

Figure 3:
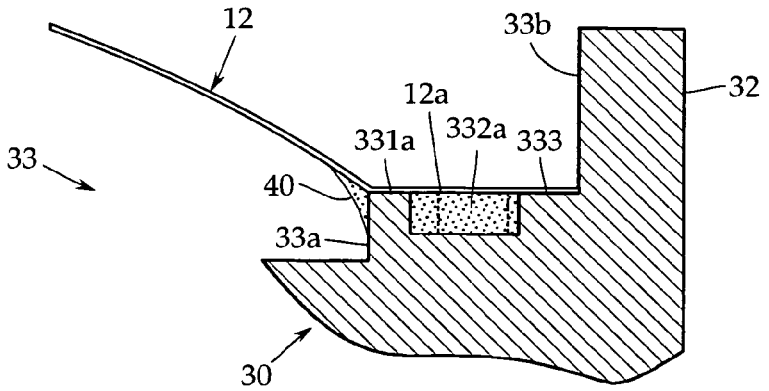
FIG. 3 is a sectional view similar to FIG. 2, showing a state in which a flange part of a sub dome has been bonded to a support face of a unit frame.

As shown in FIG. 3, the flange part 12*a* of the sub dome 12 is bonded to the support face 33 via an adhesive 40. As the adhesive 40, an ultraviolet-curing resin that has elasticity even after curing is preferably used.

According to this configuration, the bonding area of the flange part 12*a* increases gradually in the order of the first boss group 331, the second boss group 332, and the flat part 333. Accordingly, the mechanical impedance of the bonding portion also increases at a predetermined gradient from the inside end 33*a* toward the outside end 33*b*. Therefore, the traveling waves propagated from a center dome 11 (refer to FIG. 5) are absorbed by the bonding portion, and the occurrence of end reflected waves that are a cause for abnormal resonance is prevented effectively.

Also, the excess of the adhesive 40 intrudes into a void between the bosses and tends to stay in the void due to its own wettability, so that less adhesive 40 squeezes out.

In addition to providing a pressure gradient for the mechanical impedance of the bonding portion as described above, it is preferable that, in order to uniformly distribute the bonding portions of the flange part 12*a*, the first bosses 331*a* of the first boss group 331 and the second bosses 332*a* of the second boss group 332 be arranged alternately (zigzag arrangement), and a concave curved face 333*a* having almost the same curvature as that of the second boss 332*a* be formed on the face facing the second bosses 332*a* of the flat part 333 as shown in FIG. 1.

The bosses 331*a* and 332*a* in the above-described embodiment are of a cylindrical shape. However, these bosses may be of a prismatic shape.

Figure 4:
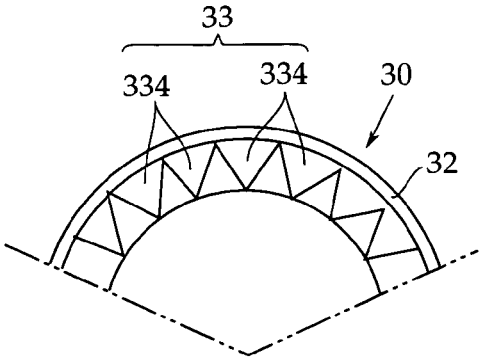
FIG. 4 is a plan view showing another embodiment of the present invention.

Also, in place of the bosses, as shown in FIG. 4, a plurality of triangular support pedestals 334 directed from the rib 32 side to the center of the unit frame 30 may be formed as the support face 33 for the flange part 12*a*. By this configuration as well, the above-described pressure gradient can be provided for the mechanical impedance of the bonding portion.

The invention claimed is:

1. An electroacoustic transducer comprising:

a diaphragm having a center dome and a sub dome connectingly provided around the center dome, the sub dome being formed with a flat flange part at a peripheral edge thereof, and a unit frame for oscillatably supporting the diaphragm, the unit frame being formed with a flat support face facing the flange part, and the flange part being attached to the support face via an adhesive, wherein a bonding area of the support face and the flange part increases gradually from an inside end of the support face to an outside end thereof, and wherein the support face includes a first boss group in which a plurality of first bosses is arranged at predetermined intervals along the inside end of the support face, and a second boss group in which a plurality of second bosses each having a diameter larger than that of the first boss is arranged at predetermined intervals on an outside of the first boss group.

2. The electroacoustic transducer according to claim 1, wherein the adhesive shows elasticity after curing.

3. An electroacoustic transducer comprising:

a diaphragm having a center dome and a sub dome connectingly provided around the center dome, the sub dome being formed with a flat flange part at a peripheral edge thereof, and a unit frame for oscillatably supporting the diaphragm, the unit frame being formed with a flat support face facing the flange part, and the flange part being attached to the support face via an adhesive, wherein the flat support face includes a plurality of triangular pedestals directed from an outside end of the support face to an inside end thereof so that a bonding area of the support face and the flange part increases gradually from the inside end to the outside end.

4. The electroacoustic transducer according to claim 3, wherein the adhesive shows elasticity after curing.

5. The electroacoustic transducer according to claim 3, wherein each of the triangular pedestals has a point directed to the inside end.

* * * * *